US010279966B1

(12) United States Patent
Solomon

(10) Patent No.: US 10,279,966 B1
(45) Date of Patent: May 7, 2019

(54) HUMIDITY-STABILIZING DEVICE FOR DRIED LEAFY MATERIAL AND HERBS

(71) Applicant: Robin Solomon, Bronx, NY (US)

(72) Inventor: Robin Solomon, Bronx, NY (US)

( * ) Notice: Subject to any disclaimer, the term of this patent is extended or adjusted under 35 U.S.C. 154(b) by 0 days.

(21) Appl. No.: 15/793,107

(22) Filed: Oct. 25, 2017

(51) Int. Cl.

| | |
|---|---|
| ***B65D 51/30*** | (2006.01) |
| ***B65D 43/02*** | (2006.01) |
| ***A24F 25/00*** | (2006.01) |
| ***B65D 85/50*** | (2006.01) |

(52) U.S. Cl.
CPC ..... *B65D 51/30* (2013.01); *A24F 25/00* (2013.01); *B65D 43/0231* (2013.01); *B65D 85/505* (2013.01); *B65D 2543/00537* (2013.01)

(58) Field of Classification Search
CPC . A61J 1/03; A24F 25/00; B65D 43/02; B65D 43/0231; B65D 51/28; B65D 51/30; B65D 81/26; B65D 81/264; B65D 81/266; B65D 81/267; B65D 81/268; B65D 85/50; B65D 85/505; B65D 2543/00537
USPC ..... 206/204; 96/147–153
See application file for complete search history.

(56) References Cited

U.S. PATENT DOCUMENTS

| | | | | |
|---|---|---|---|---|
| 1,871,418 A | | 4/1929 | Mckee | |
| 2,548,168 A | * | 4/1951 | Luce | B65D 51/30 96/148 |
| 3,245,737 A | * | 4/1966 | Kleinhans | A24F 25/02 206/204 |
| 3,431,038 A | | 3/1969 | Berliner | |
| 4,406,843 A | | 9/1983 | Nakamura et al. | |
| 4,572,051 A | | 2/1986 | Laskin | |
| 4,636,328 A | * | 1/1987 | Flynn | B65D 51/28 215/227 |
| 5,934,773 A | | 8/1999 | Ferrell | |
| 5,936,178 A | | 8/1999 | Saari | |
| 6,027,187 A | | 2/2000 | Siepmann | |
| 6,089,237 A | | 7/2000 | Podolak, Jr. et al. | |
| 6,094,917 A | | 8/2000 | Sundhar et al. | |
| 6,116,029 A | | 9/2000 | Krawec | |
| 6,157,306 A | | 12/2000 | Mularoni | |
| 6,367,620 B1 | | 4/2002 | Kelifa | |
| 6,986,807 B2 | * | 1/2006 | Brunk | B65D 51/30 206/204 |
| 7,892,327 B2 | | 2/2011 | Neff | |
| 7,967,400 B1 | | 6/2011 | Collum | |
| 8,211,209 B2 | | 7/2012 | Neff | |
| 8,342,185 B2 | | 1/2013 | Egued | |
| 8,579,107 B2 | | 11/2013 | Egued | |
| 8,919,546 B2 | * | 12/2014 | Wada | B65D 81/26 206/204 |

(Continued)

*Primary Examiner* — Bryon P Gehman
(74) *Attorney, Agent, or Firm* — Keeley DeAngelo LLP; W Scott Keeley

(57) ABSTRACT

A humidity-stabilizing device for tobaccos or dried herbs that can be attached to the interior of a lid of a container to control relative humidity in the container. The device is a sealable container with internal compartments which are divided by a moisture-permeable barrier. The compartments separately hold moisture-absorbent material and humidity-stabilizing silica gel beads that together maintain the relative humidity of the container by action of evaporation and absorption. Because evaporate rather than water is employed in the humidification process, tap water rather than distilled water can be used to wet the moisture-absorbent material.

9 Claims, 6 Drawing Sheets

(56) References Cited

U.S. PATENT DOCUMENTS

| | | | | |
|---|---|---|---|---|
| 9,005,348 | B2 | 4/2015 | Ott | |
| 9,302,795 | B1 * | 4/2016 | Beatty | B65D 81/266 |
| 9,745,114 | B2 * | 8/2017 | Dai | B65D 81/268 |
| 10,123,563 | B2 * | 11/2018 | Jackson | B65D 81/266 |
| 10,134,447 | B2 * | 11/2018 | Beatty | B65D 81/266 |
| 2007/0084735 | A1 * | 4/2007 | Lancesseur | B65D 51/30 206/204 |
| 2008/0257151 | A1 * | 10/2008 | Mayer | B65D 81/268 206/204 |
| 2016/0122117 | A1 * | 5/2016 | Moore | B65D 81/268 206/204 |
| 2017/0001140 | A1 * | 1/2017 | Lebon | B01D 53/261 |

* cited by examiner

100

HUMIDITY-STABILIZING DEVICE FOR DRIED LEAFY MATERIAL AND HERBS

TECHNICAL FIELD

The present disclosure relates to humidors and humidity-stabilizing devices for dried herbs.

BACKGROUND

Smoking materials (cigars, loose tobacco, and various dried herbs) must be kept at a consistent humidity level to maintain flavor, freshness, and potency. Without adequate humidity the materials will dry out; excessive humidity can cause mildew and/or mold.

Smoking materials require specific relative humidity (RH) levels. Cigars are normally kept at 65-75% RH. Dry, pre-rolled cigarette tobacco is best stored around 60% RH. Dried herbs are best stored at approximately 50%-65%. The most effective humidity-stabilization devices effect two-way humidity control, working as both humectant and desiccant. These devices prevent mildew and mold and maintain smoking materials within a proper RH range regardless of environmental humidity.

Silica gel is a granular, vitreous, porous form of silicon dioxide made synthetically from sodium silicate. Silica gel contains a nano-porous silica micro-structure suspended in a liquid. Silica gel beads, commonly used for removing moisture from packaging containers, may be calibrated with a coating of mineral salts to absorb or release humidity in various RH ranges, providing a buffering effect on relative humidity. This action referred to as two-way humidity control.

Silica gel beads commonly require distilled water for use in saturating the beads. Saturating beads is also referred to as charging the beads.

One skilled in the art understands that common two-way humidity maintenance devices for smoking materials are most commonly cigar-specific and, as such, maintain humidity levels that are too high for loose tobacco and dried herbs. Humidity-stabilizing devices designed to maintain ideal humidity levels for loose tobacco and dried herbs are either disposable or require maintenance of a humidor and use of distilled water.

SUMMARY

Disclosed herein is a humidity-stabilizing device for converting a container into a humidor that is maintained using ordinary tap water. In some embodiments the container is a glass jar that is between a 4-oz and 32-oz size by volume.

In an example embodiment, a sealable container has two internal compartments that are separated by a moisture or vapor permeable barrier. One of the compartments contains humidity stabilization beads that are designed to maintain the surrounding environment between 45% and 70% relative humidity, otherwise referred to as the optimal RH level for the smoking materials and dried herbs. The other contains an absorbent material that absorbs a sufficient amount of water to properly charge the beads with a sufficient amount of moisture when the water evaporates from the absorbent material.

The device is configured to ensure physical separation between the absorbent material and the humidity stabilization beads by a vapor permeable barrier. This allows the beads to be charged by applying ordinary tap water to the absorbent material and then sealing the device. The beads are then rehydrated by evaporation of the water and transmission of evaporate through the moisture permeable barrier, thus charging the beads with evaporate. By this process, tap water may be used in lieu of distilled water that silica gel beads commonly require.

In some embodiments a means for affixing the apparatus to the inside of a container is provided, turning any jar with a metal lid into a humidor. In an example embodiment, a neodymium magnet is used to attach the apparatus to the inside of a jar lid, Neodymium magnets are particularly susceptible to corrosion, especially given the intentionally humid environment inside the apparatus and the salts contained in the beads. The apparatus uses a two-walled container, with the magnet inserted between the walls and therefore separated from the beads to prevent corrosion of the magnets.

Other objects and features will become apparent from the following detailed description considered in conjunction with the accompanying drawings. It is to be understood, however, that the drawings are designed as an illustration and not as a definition of the limits of the invention.

BRIEF DESCRIPTION OF THE DRAWINGS

The following is a brief description of the drawings, which are presented for the purposes of illustrating the disclosure set forth herein and not for the purposes of limiting the same. Example embodiments of the present disclosure are further described with reference to the appended figures. It is to be noted that the various features and combinations of features described below and illustrated in the figures can be arranged and organized differently to result in embodiments which are still within the spirit and scope of the present disclosure. To assist those of ordinary skill in the art in making and using the disclosed systems, assemblies and methods, reference is made to the appended figures, wherein.

DETAILED DESCRIPTION

Figure 1:
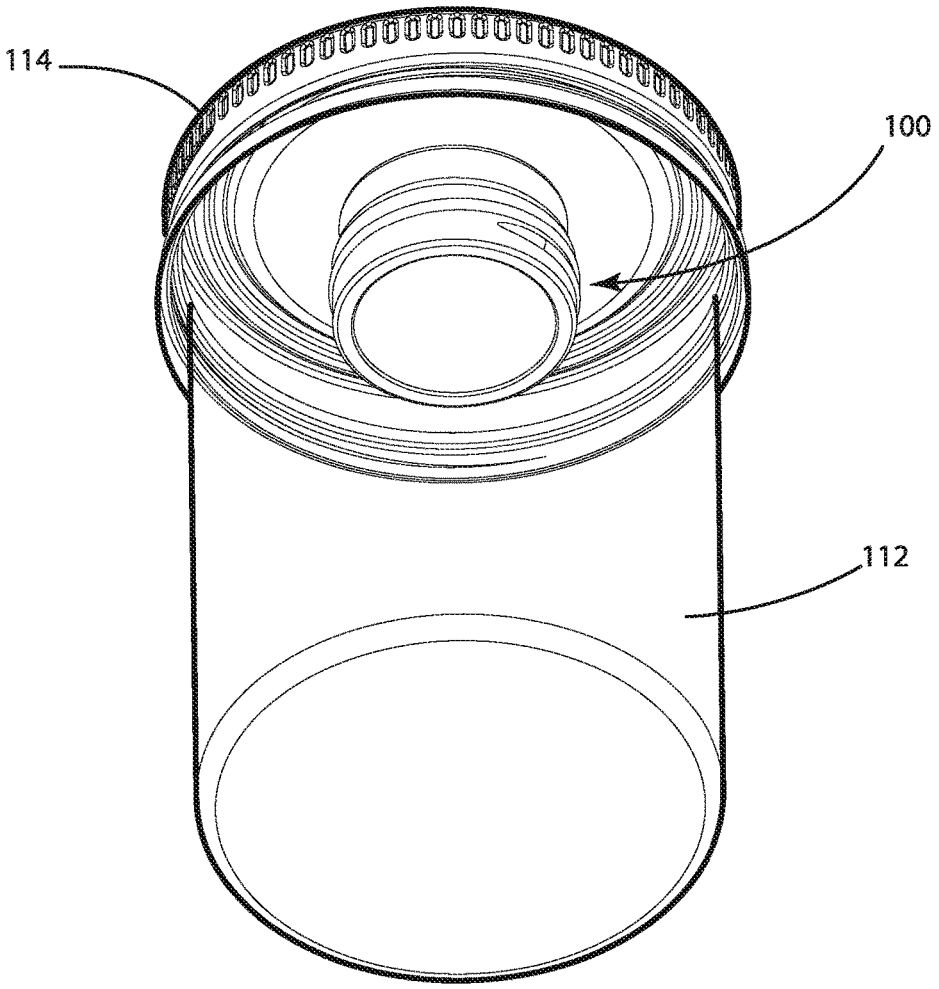
FIG. 1 is bottom, perspective view of the present embodiment.

The example embodiments disclosed herein are illustrative of a humidity-stabilizing device for the purpose of creating an environment inside ajar, the jar having a metal lid. Referring to FIG. 1, a humidifying apparatus 100 engages with a metal jar lid 114, providing an environment inside a jar 112 that is appropriate for dried herbs and smoking materials such as tobacco and the like.

Figure 2:
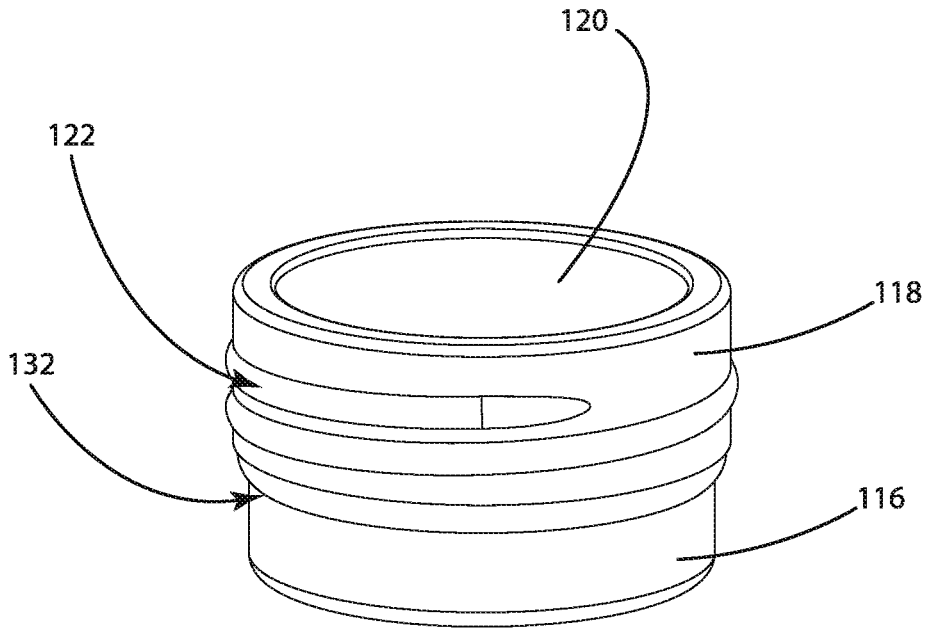
FIG. 2 is a front, perspective view of the present embodiment.

Referring to FIG. 2, the exterior of a humidity-stabilizing device 100 is shown. A base 116 having a threaded closure 132 engages with a lid 118 that has mating threads 122. The lid has a transparent cover 120. One skilled in the art understands that a threaded enclosure may also be engaged with a quarter-turn twist-lock mechanism or a snap-fit or other common means for engaging a lid with a container.

One skilled in the art also understands that in some embodiments an opaque lid may be used in place of a transparent lid.

Figure 3:
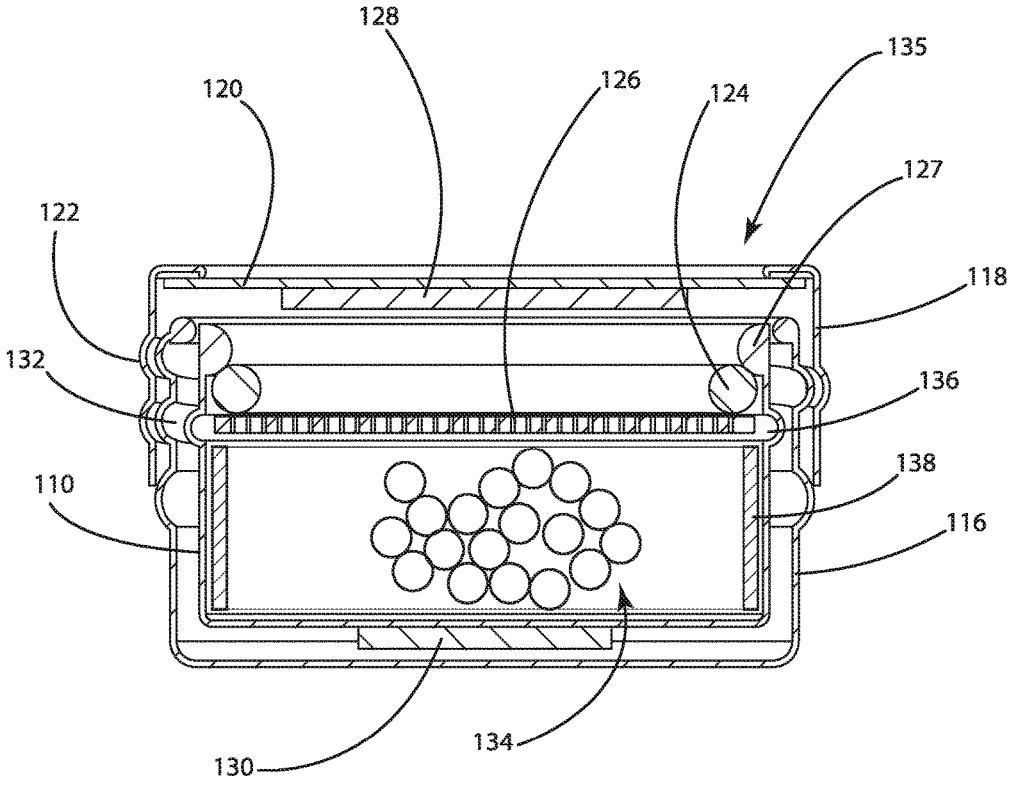
FIG. 3 is section view of the present embodiment.

The illustration in FIG. 3 depicts a cross-section of the humidification device of FIG. 2 and FIG. 1. Referring to FIG. 3 a lid 118 is removably engaged with a base 116. The base has threads 132 and the lid has mating threads 122. A transparent cover 120 is fixedly engaged with the lid 118. An absorbent material 128 is affixed to the transparent cover 120. An internal container 110 fits inside the base 116. The internal container has a flange 136 and a lip 127 that are molded into the walls of the inner container 110. A magnet 130 is engaged with bottom of the inner container 110 and serves to affix the embodiment to a metal lid of a jar 114 (FIG. 1). A screen 126 is fitted into the flange 136. An O-ring 124 is placed under tension between the screen 126 and the lip 127, thus holding the screen 126 in place in the flange 136 while allowing it to be removed by deforming and then removing the O-ring 124.

In some embodiments a spacer 138 resides between the bottom of the inner container 110 and the screen 126 to further support the screen 126. A number of humidity-stabilization beads 134 are dispersed inside the inner container 110 beneath the screen 126 and are thus held in place behind the screen 126 which is held, between the spacer 138 and the flange 136, with the O-ring 124.

Figure 4:
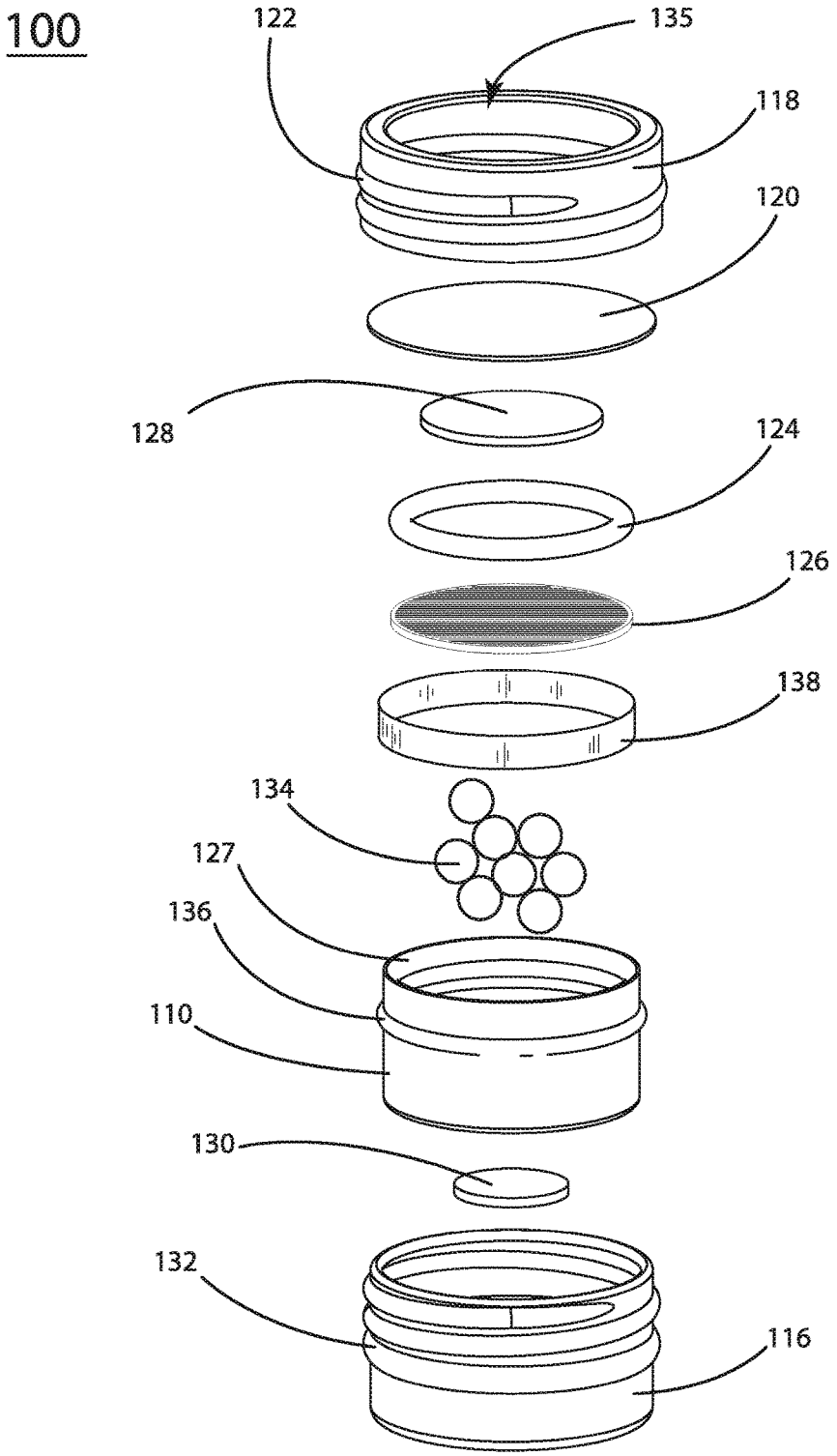
FIG. 4 is an exploded view of the present embodiment.

Referring to FIG. 4, the illustration depicts an exploded view of the embodiment including the base 116 having threads 132. The magnet 130 is to be engaged with the inner container 110. The inner container has a flange 136 and lip 127. Humidity-stabilization beads 134 are to be placed inside the inner container 110. A screen 126 is engaged between the flange 136 and the O-ring 124 thus containing the humidity stabilization beads 134. In some embodiments a spacer 138 resides between the bottom of the inner container 110 and the screen 126 so as to support the screen 126. Absorbent material 128 is engaged with the transparent cover 120 that fits inside an opening 135 in the lid 118. The lid has threads 122 for mating with threads 132. Loosening the threads 122/132 or partially opening the lid 118 allows the ambient air to flow through the container 116/118 and through the screen 126 so as to come in contact with the humidity-stabilization beads 134.

In use, the device is engaged by way of the magnet 130 with a ferrous metal jar lid 114 (FIG. 1) inside a jar 112. The lid FIG. 2, 118 is partially unscrewed about the threads 132 and mating threads 122 such that the lid 118 and base 116 do not have an air-tight seal between them. Air is allowed to flow through the assembly. Water soaked into the absorbent material FIG. 4, 128 evaporates into the humidity-stabilization beads. The absorption process works best when the lid 118 is closed. Moisture in the environment will be further absorbed into the humidity-stabilization beads 134 while a relatively dryer environment will cause moisture in the humidity-stabilization beads 134 to be released. Because the water in the absorbent material 128 eventually evaporates into the humidity-stabilization beads 134. By this method, it is evaporate that enters the humidity stabilization beads rather than liquid.

One skilled in the art understands that it is not beneficial to add ordinary tap water to humidity-stabilization beads, however evaporate is not harmful to humidity-stabilization beads. The embodiment provides for the use of ordinary tap water to humidify humidity-stabilization beads.

Figure 5:
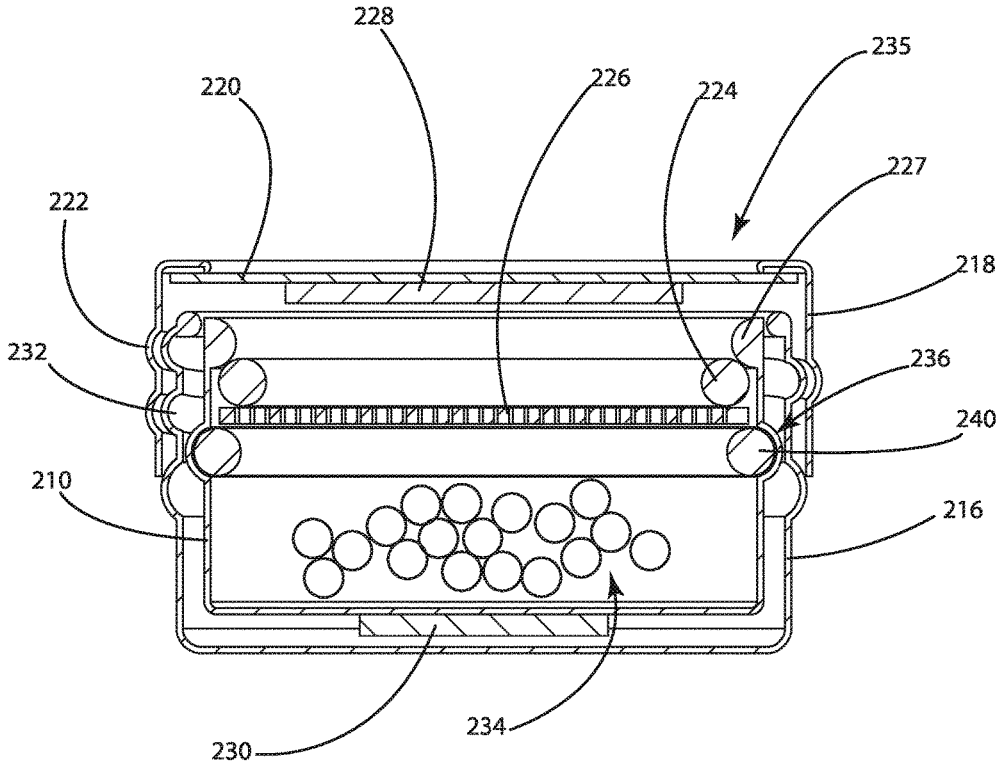
FIG. 5 is section view of an iteration of the present embodiment.

The illustration in FIG. 5 depicts a cross-section of an iteration of the humidification device of FIG. 1 and FIG. 2. Referring to FIG. 5, a lid 218 is removably engaged with a base 216. The base has threads 232 and the lid has mating threads 222. A transparent cover 220 is fixedly engaged with the lid 218. An absorbent material 228 is affixed to the transparent cover 220. An internal container 210 fits inside the base 216. The internal container has a flange 236 and a lip 227 that are molded into the walls of the inner container 210. A magnet 230 is engaged with bottom of the inner container 210 and serves to affix the embodiment to a metal lid of a jar 114 (FIG. 1). A first O-ring 240 is fitted into the flange 236. A screen 226 rests atop the first O-ring 240. A second O-ring 224 is placed under tension between the screen 226 and the lip 227, thus holding the screen 226 in place against the first O-ring 240 that is prevented from moving downward by the flange 236 while allowing the screen to be removed by deforming and then removing the second O-ring 224.

A number of humidity-stabilization beads 234 are dispersed inside the inner container 210 beneath the screen 226 and are thus held in place behind the screen 226 which is held, between the two O-rings 240 and 224.

Figure 6:
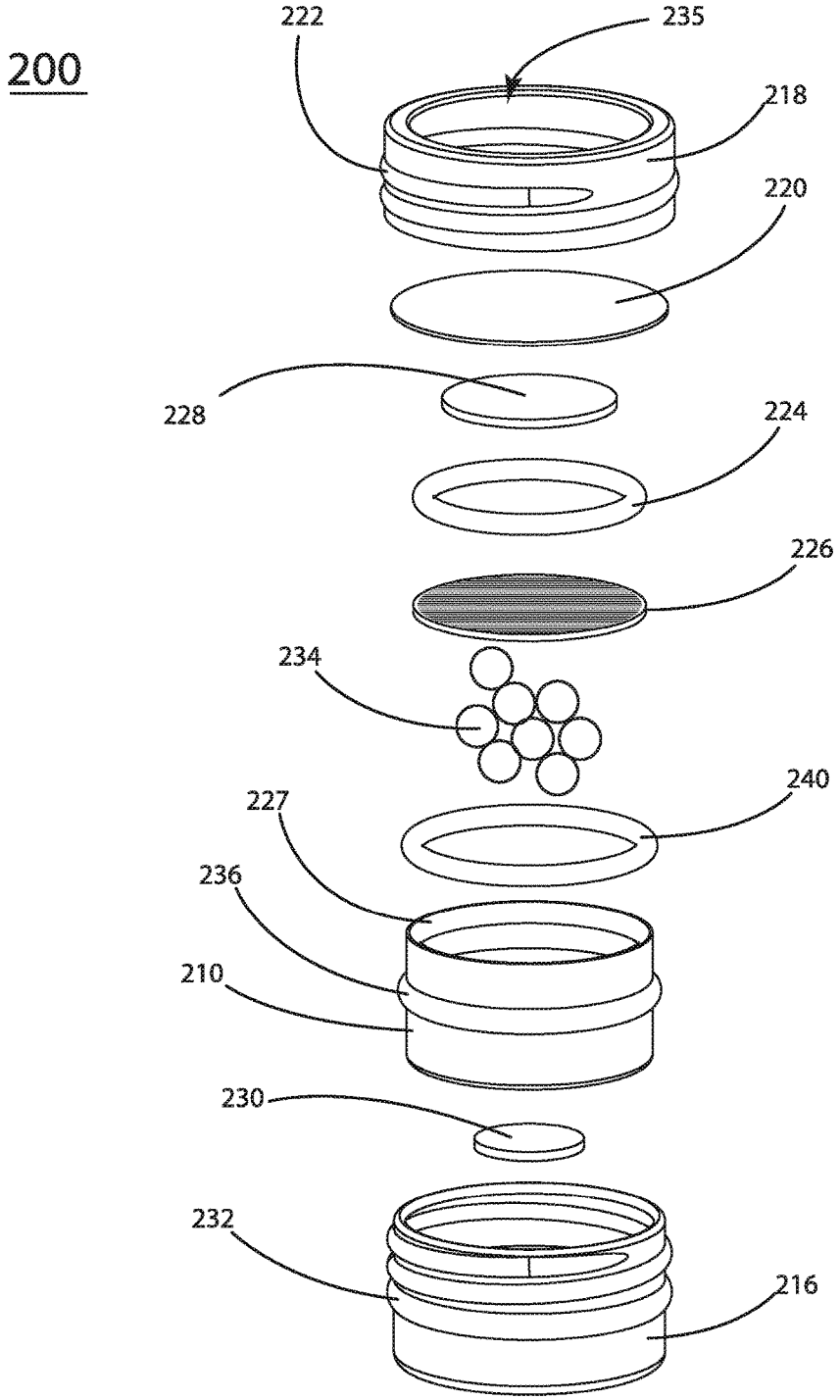
FIG. 6 is an exploded view of the iteration of the embodiment of FIG. 5.

Referring to FIG. 6, the illustration depicts an exploded view of the embodiment of FIG. 5 including the base 216 having threads 232. The magnet 230 is to be engaged with the inner container 210. The inner container has a flange 236 and lip 227. Humidity-stabilization beads 234 are to be placed inside the inner container 210. A screen 226 is engaged between a first O-ring 240 that resides in the flange 236 and a second O-ring 224 thus containing the humidity stabilization beads 234. Absorbent material 228 is engaged with the transparent cover 220 that fits inside an opening 235 in the lid 218. The lid has threads 222 for mating with threads 232. Loosening the threads 222/232 or partially opening the lid 218 allows the ambient air to flow through the container and through the screen 226 so as to come in contact with the humidity stabilization beads 234.

The present disclosure has been described with reference to example embodiments. Modifications and alterations will occur to others upon reading and understanding the preceding detailed description. It is intended that the present disclosure be construed as including all such modifications and alterations insofar as they come within the scope of the appended claims or the equivalents thereof.

Although the systems and methods of the present disclosure have been described with reference to example embodiments thereof, the present disclosure is not limited to such example embodiments and or implementations. Rather, the systems and methods of the present disclosure are susceptible to many implementations and applications, as will be readily apparent to persons skilled in the art from the disclosure hereof. The present disclosure expressly encompasses such modifications, enhancements and or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

The invention claimed is:

1. An apparatus for humidifying herbs comprising:

a first container that is porous; and silica-gel beads are contained within said first container; and said first container is contained within a second container; and said second container has vents; and a fluid-absorbent material is contained within the second container; and said fluid-absorbent material is in fluid communication with, and not in physical contact with, said silica-gel beads in said first container; wherein liquid absorbed by said fluid-absorbent material evaporates and flows into the environment within the first container and second container when vents are closed, and the resultant evaporate is absorbed by said silica-gel beads, and the apparatus, when inserted into a provided container, with vents of said second container open, maintains the moisture level in the provided container.

2. The apparatus of claim 1 wherein the moisture level maintained in the provided container is maintained between 45% and 70%.

3. An apparatus for humidifying herbs comprising:

a cylindrical first container; and the first container comprising:

a base having a bottom surface; and a cylindrical side-surface; and a lid, removably engaged with the first container base; and the lid having a cylindrical lid side-surface and a lid top surface, and a pad of absorbent material engaged with the lid top surface; and a cylindrical second container having a bottom and a cylindrical side-wall; and silica gel beads contained in the cylindrical second container; and the cylindrical second container having a porous lid; wherein the environment in a provided, surrounding container, is humidified as the silica beads are placed inside the second container, the second container contained within the first container and the pad of absorbent material when soaked in liquid, wets the silica beads as the liquid in the pad of absorbent material evaporates and transfers through the screen to the silica beads; the first and second container, in combination, when inserted into a provided container the humidity level is raised and maintained in the provided container up to between 45% and 70%.

4. The apparatus of claim 3 wherein the first container lid further comprises:

an opaque cylindrical side wall; and a transparent top surface.

5. The apparatus of claim 3 wherein the porous lid is a flat round screen.

6. The apparatus of claim 5 wherein the cylindrical second container further comprises a lip that is an annular ridge about the top of the cylindrical side-wall; and a flange that is an annular indentation in the inner surface of the second container side-wall; and an O-ring; wherein the porous lid is a diameter that fits within the flange and the O-ring fits between the lip and the porous lid, holding the porous lid in place between the flange and the O-ring.

7. The apparatus of claim 3 wherein the porous lid is a flat round screen and the cylindrical second container further comprises a lip that is an annular ridge about the top of the cylindrical side-wall; and a flange that is an annular indentation in the inner surface of the second container side-wall; and an O-ring; and a cylindrical spacer; wherein the porous lid is a diameter that fits within the flange and the cylindrical spacer resides between the flat round screen and the bottom surface of the second container, supporting the flat round screen; and the O-ring fits between the lip and the flat round screen, removably engaging the flat round screen within the flange and between the spacer and the O-ring.

8. An apparatus for humidifying herbs comprising:

a cylindrical first container; and said first container comprising:

a base having a bottom surface; and a cylindrical side-surface; and a lid, removably engaged with the first container base; and the lid having a cylindrical side-surface and a top surface, and a pad of absorbent material engaged with the lid top surface; and a cylindrical second container having a bottom and a cylindrical side-wall; and silica-gel beads contained in the cylindrical second container; and the cylindrical second container having a flange that is an annular indentation in the inner surface of the second container side-wall; and the cylindrical second container having a lip that is an annular ridge about the top of the cylindrical side-wall; and a spacer that is a cylindrical ring; and the spacer residing inside the cylindrical second container; and a flat, round screen; and the screen resting atop the spacer and in the flange; and an O-ring; and the O-ring removably engaged between the cylindrical second container lip and the screen; and a magnet; and the magnet engaged between the bottom surface of the second container and the bottom surface of the first container; wherein the silica gel beads are placed inside the second container with the spacer surrounding the silica gel beads, the screen is engaged against the top of the spacer, in the flange, and held in place by the O-ring that is engaged between the second container lip and the screen, holding the screen in place, the second container contained within the first container and the pad of absorbent material wets the silica gel beads as the liquid in the pad of absorbent material evaporates and transfers through the screen to the silica-gel beads;

the magnet engages with a metallic surface of an example, provided jar-lid.

9. The apparatus of claim 8 wherein the metallic surface is a metal jar lid that is engaged with a jar; wherein the apparatus, when partially opened, maintains the humidity in the jar between 45% and 70%.

* * * * *